United States Patent [19]

Belongia et al.

[11] Patent Number: 4,971,263

[45] Date of Patent: Nov. 20, 1990

[54] INTERIOR RIDER ROLL

[75] Inventors: Larry P. Belongia, Oconto Falls; Brian J. Gruszynski, Peshtigo, both of Wis.

[73] Assignee: Magna-Graphics Corporation, Oconto Falls, Wis.

[21] Appl. No.: 269,672

[22] Filed: Nov. 10, 1988

[51] Int. Cl.[5] ..... B65H 18/04

[52] U.S. Cl. ..... 242/64; 242/67.1 R

[58] Field of Search ..... 242/64, 56 A, 67.1 R, 242/66

[56] References Cited

U.S. PATENT DOCUMENTS

| | | | |
|---|---|---|---|
| 2,360,564 | 10/1944 | Johnstone | 242/66 |
| 2,596,208 | 5/1952 | Carter | 242/66 |
| 3,206,134 | 9/1965 | Printz et al. | 242/66 |
| 3,232,549 | 2/1966 | Stambaugh | 242/66 |
| 3,373,952 | 3/1968 | Klaczkiewicz | 242/66 |
| 4,431,140 | 2/1984 | Tetro | 242/64 X |
| 4,529,141 | 7/1985 | McClenathan | 242/56 A |

*Primary Examiner*—John M. Jillions

[57] ABSTRACT

A web rewind apparatus includes an interior rider roll unit moving with a turret and engaging the winding roll during winding and particularly during indexing to move a new core in place and remove the winding roll. The rider rill is pivotally mounted within the roll support, rotates with the rewinding roll and engages the roll during rewinding or during indexing only. In another form, the rider roll is mounted on the turret by a linear slide and a counterweight member. A coupling connects the rider roll unit and the counterweight member to create an essentially zero gravity force by the rider roll unit. A pistonless cylinder is coupled to the counterweight to apply a constant surface force on the rider roll and thereby on the winding roll. The rider roll is mounted on the slide unit in a suitable bearing unit with the axis of the rider roll parallel to the winding axis. Adjustable bearing units mounted to the slide and permit skewing of the rider roll relative to the winding axis.

20 Claims, 5 Drawing Sheets

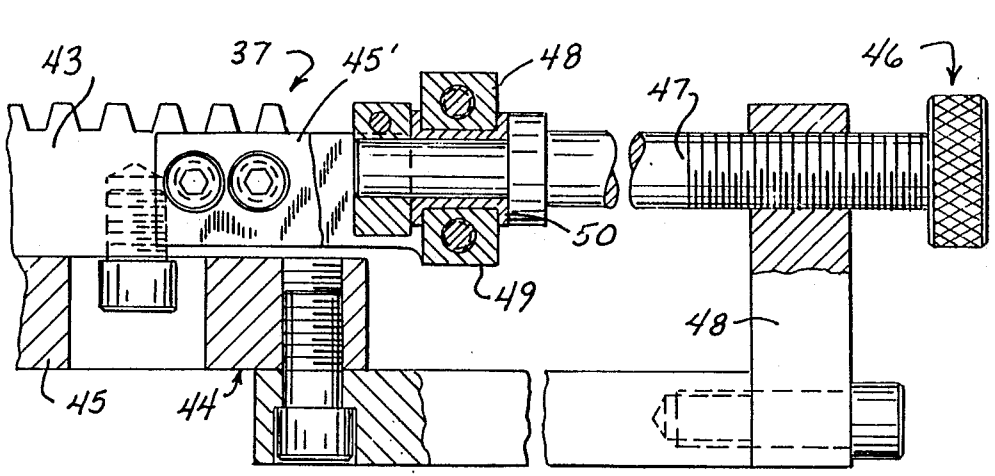
FIG. 1
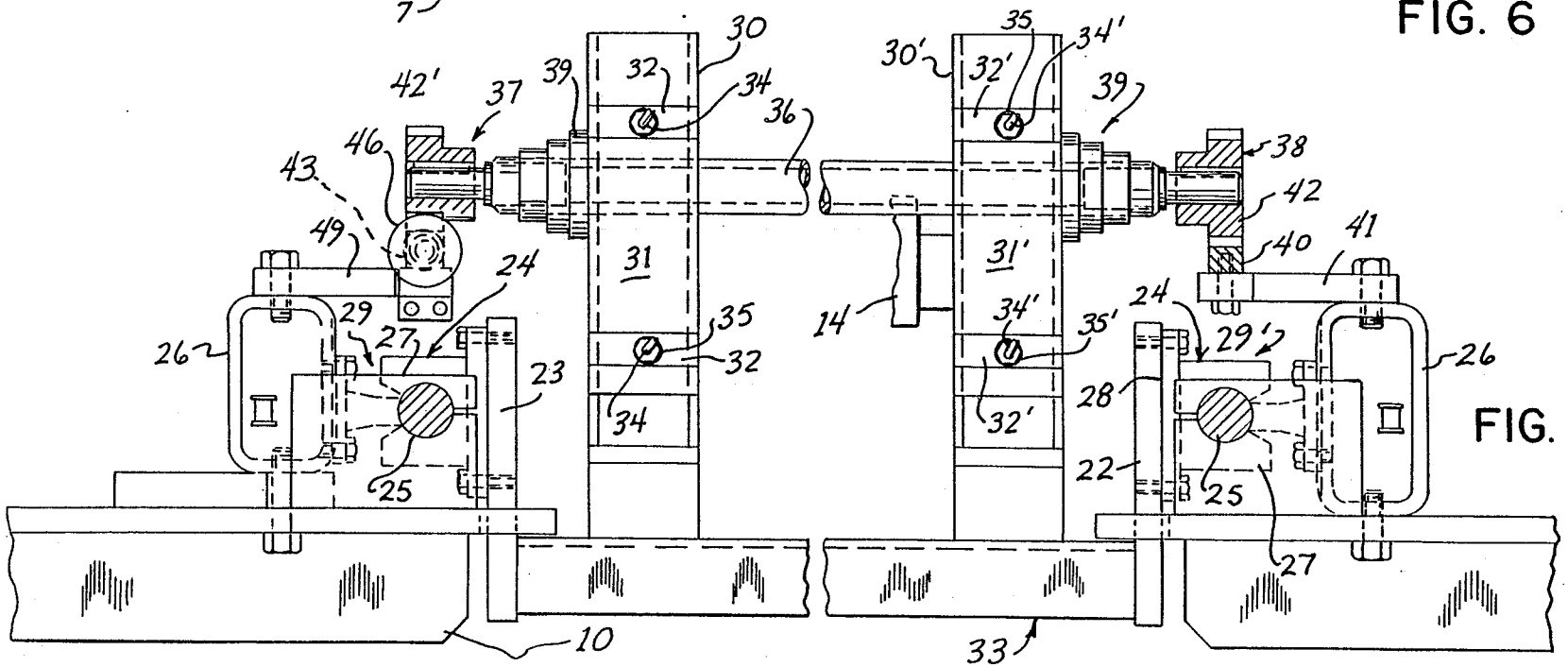
FIG. 2
FIG. 6

INTERIOR RIDER ROLL

BACKGROUND OF THE PRESENT INVENTION

The present invention is directed to a web winding apparatus having a rider roll in surface engagement with a wound roll during the winding and particularly to a rider roll moving with an indexing of the rewound roll during the final winding.

In winding of a thin web of film-like material, a length of indefinite length may be rewound into a plurality of successive rewound rolls. The web supply includes supply rolls having a mechanism to connect webs of successive supply rolls without interruption of the web flow to the rewind apparatus. The winding apparatus includes a turret having circumferentially spaced roll core support units. The turret is rotatably indexed to successively position the core support units between a rewind station and an unload station. As more fully disclosed in the copending application, Ser. No. 07/055,697, filed May 29, 1987, now U.S. Pat. No. 4,798,350, entitled "Web Rewind Apparatus With Cutless Web Transfer" and assigned to a common assignee with this application, the winding station includes a cutoff and transfer mechanism to sever the web and transfer the free end of the web to a new core unit during the final winding of a rewound roll.

The rider roll is conventionally mounted as a component of the station. As the rewound roll is rotated from the winding station, the web continues to be wound on the roll, without a rider roll. The final wraps may therefore not be optimumly wound.

Further, in certain applications, the paper or web is sensitive to any external pressure applied to the outer web layer of the winding roll. For example, pressure responsive carbonless copy paper includes minute bubbles, which can be broken if other than a light pressure is applied to the winding roll, with a corresponding waste product resulting.

SUMMARY OF THE INVENTION

The present invention is particularly directed to an interior rider roll unit mounted to move with a winding roll support for engaging a winding roll of a film-like material during winding of the wound roll including movement of the roll support, and particularly to an interior rider roll unit establishing a constant surface force on the roll surface. An interior rider roll provides an improved wrapping of a roll and particularly the final wraps including the wraps following the separation of the web from the wound roll. The interior rider roll unit may be mounted to engage the rewound roll during the rewind of the roll at the rewind station or move into engagement with the rewound roll during the indexing of the rewound roll. In one embodiment, a rider roll is pivotally mounted within the roll support and rotates with the rewound roll to establish and maintain surface engagement with the outermost web layer. Although the interior rider roll improves the winding characteristic and an improved wound roll, a simply pivoted rider roll may create a varying surface force with the rotating of the roll support and the pivoting of the rider roll. Generally, in accordance with the present invention particularly for pressure sensitive paper or other web material, a rider roll assembly includes a movable rider roll unit coupled to a force and weight control unit having a counterweight member coupled to balance the weight of the roll unit and a force unit to establish and maintain a constant surface force on the outer layer of the roll unit.

In a preferred and unique embodiment, the rider roll assembly includes a rider roll rotatably mounted on a linear slide unit which is in turn mounted to the winding roll support. A counterweight member is movably mounted on a control unit support structure which is also mounted to the winding roll support. A position transfer coupling unit connects the rider roll unit and the counterweight to establish opposite movements of the roll and counterweight and thereby establish an essentially zero gravity force by the rider roll unit. A constant force generator is mounted to the control unit support structure and coupled to the counterweight system to establish and apply the constant surface force on the rider roll. The rider roll thus maintains a constant surface force on the wound roll surface during the complete or final winding of the roll winding cycle.

In accordance with a further aspect of the present invention, the rider roll is mounted on the slide unit in suitable bearing units with the axis of the rider roll parallel to the winding axis. The bearing units are constructed and arranged to permit slight skewing of the rider roll axis relative to the winding axis. An adjustable position unit is coupled to the bearing units and to the slide support unit to set the rider roll axis. The setting of the rider roll skew eliminates defects such as wrinkles and folds within a layer of the roll.

More particularly, in a preferred construction, a turret rotates about a horizontal axis and includes oppositely extended first and second support arms. Core support members are secured to the ends of the arms and releasably support a core unit having a rotational axis parallel to the turret axis. A motor drive indexes the turret to sequentially align the core support arms with the winding station for receiving the web and winding the web on the core unit. The interior rider roll unit is secured to the turret for each of said core support members. Each interior rider roll unit includes a carriage unit slidably secured to the turret for movement relative to the core support members. The rider roll is mounted on a pair of axially spaced bearing stands with the rider roll axis generally parallel to the axis of core support members. Each rider roll unit includes first and second control units connected to the opposite ends thereof. Each of said control units is identically formed and includes a roll position related mechanism connected to the carriage unit and having an output member positioned in accordance with the rider roll. The control unit includes a counterbalance weight unit movably mounted and a weight position mechanism having an output connected to the weight unit. A coupling mechanism connects the weight unit to counterbalance the weight of the rider roll. The coupling mechanism may establish a fixed reduction in the movement of the weight with respect to the movement of the rider roll to maintain the zero force where the counterweight is used throughout the winding process. A one-to-one relationship may be used where the rider roll only engages the roll during indexing and it thus has a short stroke. In the preferred construction, the weight positioning mechanism includes a weight chain unit mounted to a mounting plate and including a chain member fixed to the weight and supported by a plurality of spaced sprockets rotatably mounted to the mounting plate. The roll positioning mechanism includes a roll position chain unit mounted on the plate in laterally spaced relation to said weight chain unit. The roll position chain unit includes a plurality of spaced sprockets mounted to the plate with the chain movement in a plane parallel to the plane of the weight chain. The coupling mechanism includes a transfer chain unit having sprocket members secured to sprockets of the weight chain unit and of the transfer chain unit. The chain coupling may provide a one-to-one relationship when the rider roll only makes contact with the winding roll just prior to indexing, or may provide reduction in movement of the weight chain unit with the position chain unit when the rider roll engages the core and roll during the winding. A coupling plate is affixed to the rider roll unit for simultaneous positioning of the weight chain with the position of the linear moving rider roll, and thereby establishing an essentially weight-free force at the rider roll. A piston-less cylinder unit is connected to move with the weight and transmits a constant force through the chain units, and thereby establishes a constant holding force on the rider roll unit for engagement with the wound roll.

In the preferred embodiment, a shaft is rotatably mounted to the bearing stands and projects laterally of the rider roll. First and second pinion gear and racks unit couple the shaft to the support arms. The one rack unit is longitudinally adjustable and includes an adjustable locking unit for adjusting the position of the rack and thereby adjust the angular orientation of the shaft in an offset angular orientation with respect to the axis of the core units. The angular orientation is transmitted to the rider roll and provide a skewed mounting of the rider roll.

The present invention provides a reliable rider roll apparatus for significantly improving the wound roll in a web rewinding apparatus.

BRIEF DESCRIPTION OF THE DRAWINGS

The drawings furnished herewith generally illustrate the best mode presently contemplated for the invention and are described hereinafter.

In the drawings:

FIG. 1 is a simplified side elevational view of a web rewind apparatus including a rotatable turret for supporting a plurality of winding core units and incorporating an embodiment of the present invention;

FIG. 2 is an enlarged elevational view of a rider roll carriage unit mounted to a rewind turret;

FIG. 6 is an enlarged fragmentary view, with parts broken away and sectioned, of a rider roll skew setting unit shown in FIG. 5.

DESCRIPTION OF THE ILLUSTRATED EMBODIMENT

Figure 3:
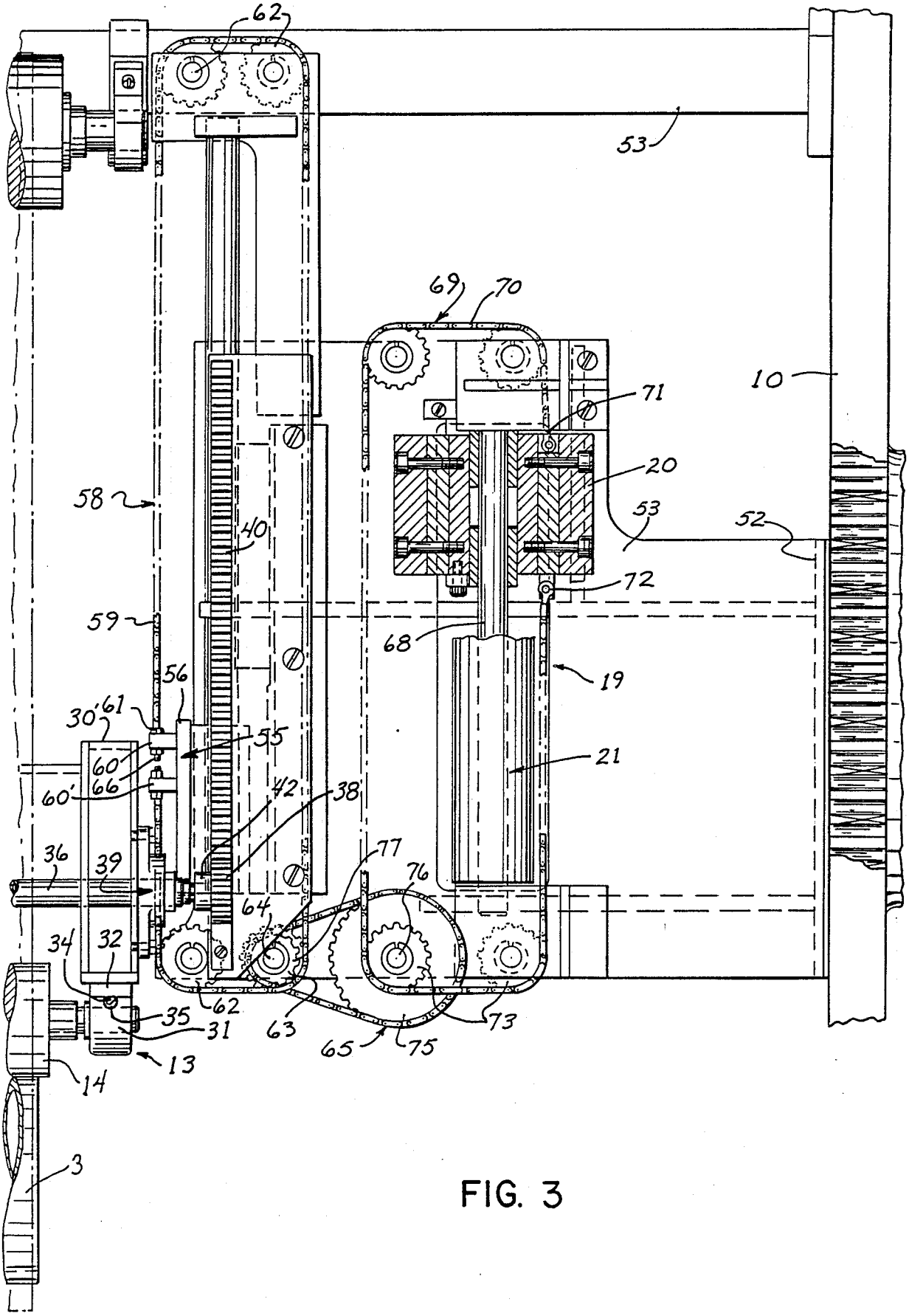
FIG. 3 is an enlarged plan view of one end of the roll carriage unit illustrating a force and counterweight control unit mounted to one side of the rider roll carriage unit and coupled to the rider roll carriage unit.

Referring to the drawings and particularly to FIG. 1, a web rewinding apparatus 1 is diagrammatically illustrated for winding of a web 2 into a wound roll 3. The web 2 is a web of indefinite length which is to be rewound into a plurality of rewound rolls. A tensioned web supply apparatus 4 supplies the web 2 to rewind apparatus 1 which includes a rewind turret 5 for receiving of web 2 and forming of rewound rolls 3. The turret 5 includes a shaft rotatably mounted in suitable end bearings 6. A motor 7 is coupled to turret 5 for rotating the turret 5. A plurality of core support and drive units, shown as a pair of diametrically spaced units 8 and 9, are secured to the opposite ends of turret arms 10. The units 8 and 9 are each adapted to support a roll core 11 for receiving of the web 2. The core 11 is rotated in any suitable manner and web 2 is thereby wound on the core 11 to form roll 3. An exterior rider roll 12 is provided at the supply apparatus 4 and may be used to support the outer wrap during the winding of roll 3. The rider roll 12 is also used during the transfer of web 2 onto the core unit at the winding station. As disclosed in the copending application, the web 2 may be separated by forming a loop in web 2 adjacent the core unit at the winding station and forcibly pulling on the web with a snap action.

In accordance with the illustrated embodiment, an interior rider roll unit 13 is secured to each end of the turret and includes a rider roll 14 which rotates therewith. Each unit 13 is similarly constructed and the one unit is shown in detail and described. The unit 13 is provided as part of an interior mounted rider roll assembly 15 secured to the turret 5, with the rider roll 14 held in engagement with the roll 3 during the complete winding cycle or at the terminal portion of forming of the final roll 3, including the transfer of the web 2 from a completed roll 3 at the load station 16 to the core 11 at the winding station 17. The rider roll assembly 15 is constructed in accordance with the teaching of the present invention, and a preferred construction is shown in FIGS. 2–7.

Generally, as shown in FIG. 1, a separate rider roll assembly 15 and 15' is provided for each core unit 8 and 9, and each is correspondingly constructed and mounted to the turret 5. The assembly 15 is shown and described in detail. The corresponding elements of assembly 15' are identified by corresponding primed numbers for simplicity and clarity of description. Further, the assemblies 15 and 15' each include counterweighted force control units 19 and 19', duplicated to the opposite end of the rider roll unit 13, and provide a balanced movement at both ends of each roll unit 13. The illustrated embodiment of FIGS. 1–6 is thus adapted for application to the winding of the carbonless copy papers or other pressure sensitive web material and winding applications or the like. The one unit 19 is shown in detail and described.

The counterweight and force control unit 19 are mounted to the turret and coupled to the ends of the roll unit 13. The unit 19 includes a counterweight unit 20 and 20' coupled to the roll unit 13 to balance the weight of roll 14 and the associated support structure and establish an essentially zero force on the engaged rewound roll 3 during the winding cycle. The unit 19 also includes a force generator unit 21 coupled to the roll unit 13 and establishing a constant force on the roll 14 and therefore on the surface of the rewound roll 3 during the complete winding cycle.

More particularly as shown in FIGS. 1 and 2, the rider roll 14 is mounted to move on a generally chordal path of the turret as the roll 3 enlarges. The movement of the rider roll 14 creates a varying gravity force on the support mechanism, as the result of the indexing turning which changes the lever of the arm weight and the location relative to the rewound roll 3. A suitable counterweight 20 and 20' is adjustably mounted within the control unit 19 and positioned in a direction opposite from that of the rider roll 14 to maintain a constant zero gravity force on the rider roll 14 relative to the enlarging rewound roll 3 during the winding of the rewound roll. The force-establishing unit 21, shown as a constant force pneumatic cylinder, is secured to the control unit 19 and establishes an opposing force through the weight unit 20 and 20' and coupling structure to the rider roll 14.

A preferred construction of a rider roll assembly 15 is shown in FIGS. 2–7 in which the roll unit 13 is mounted for linear, or straight line, motion at the diameter of the rewound roll increases.

Figure 4:
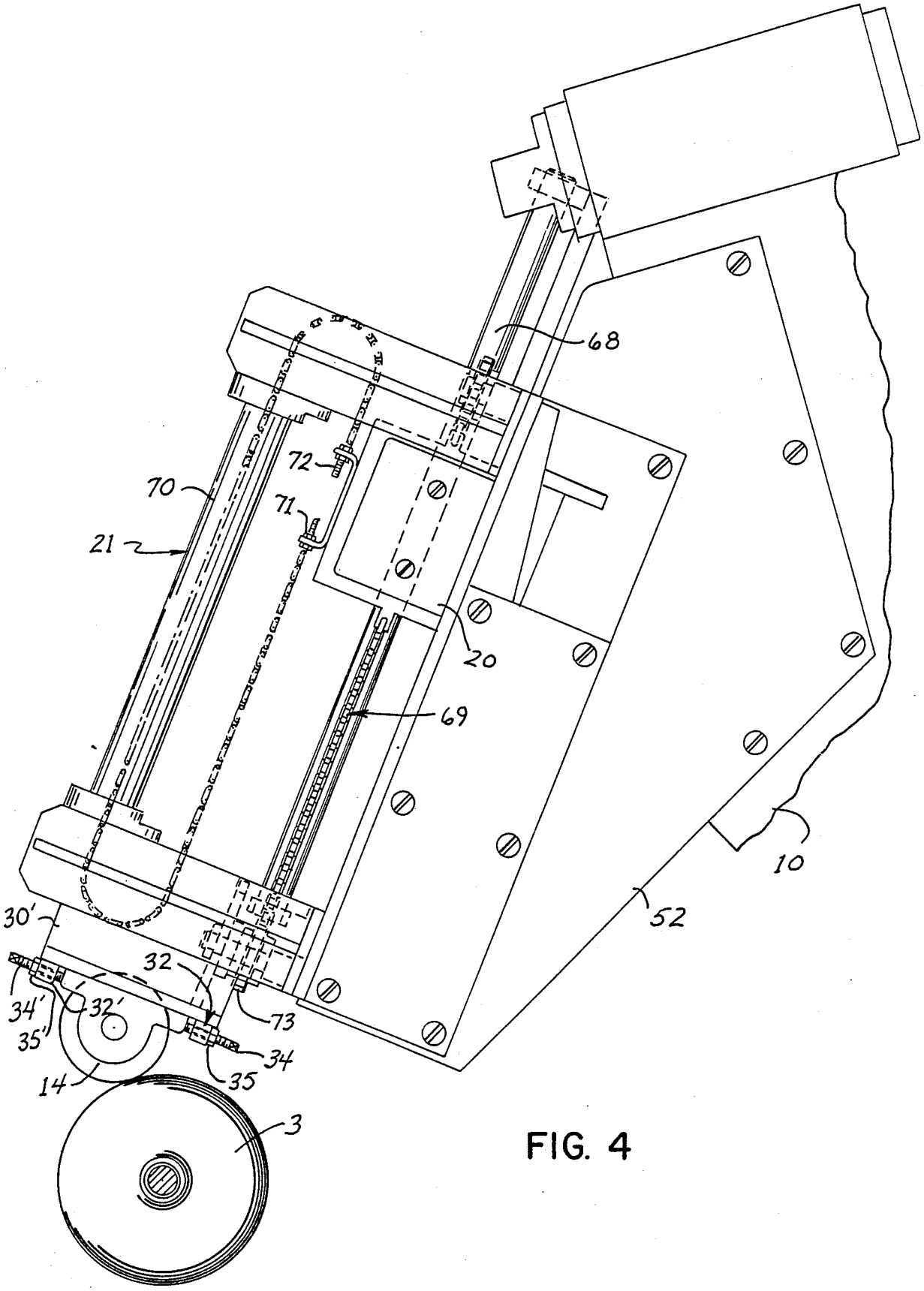
FIG. 4 is an enlarged fragmentary end view of the turret illustrating a winding core unit and the force and counterweight control unit, shown in FIGS. 1 and 2.
Figure 5:
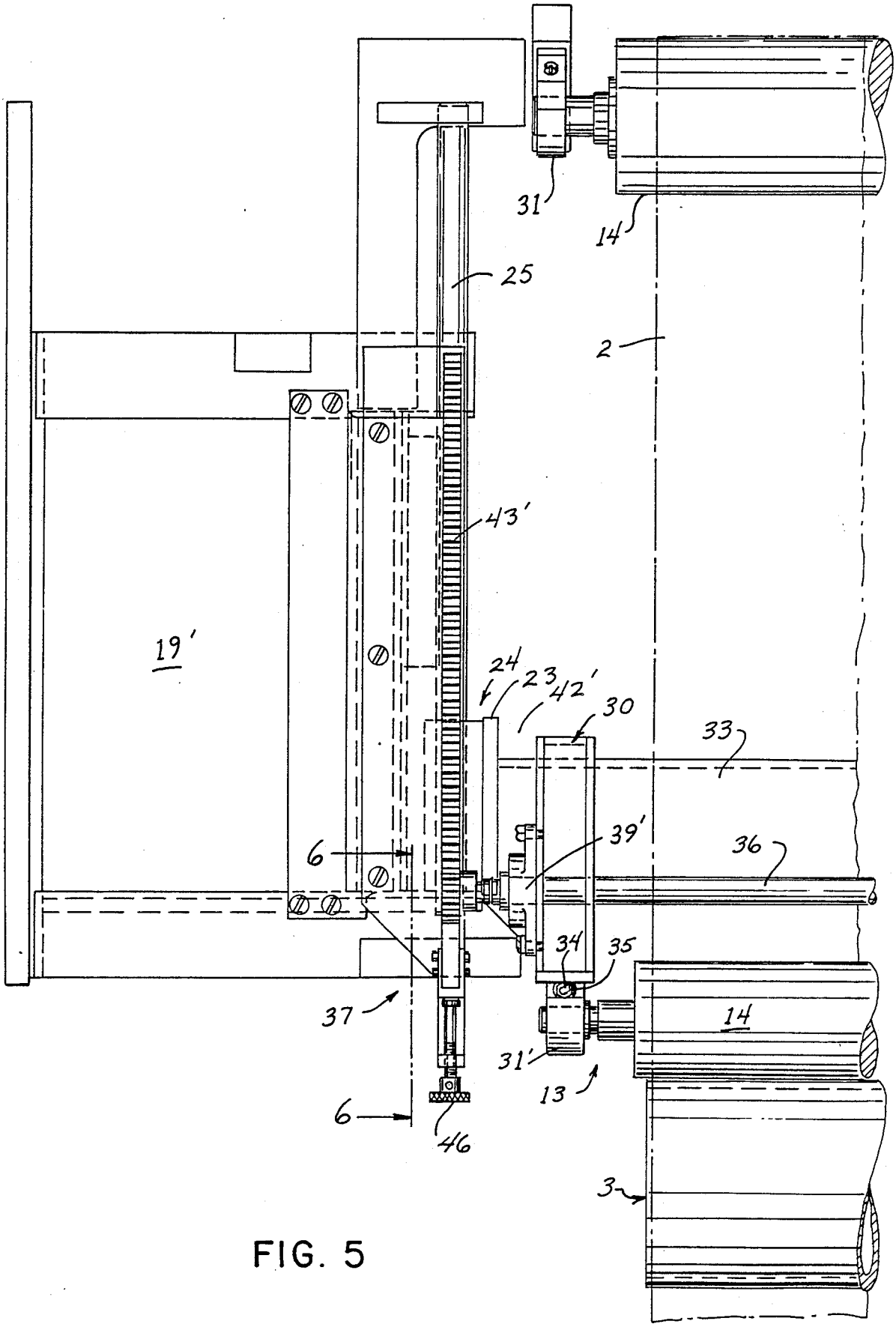
FIG. 5 is an enlarged plan view of the opposite end of the roll carriage unit.

Referring to the drawing and particularly to FIG. 4, the rider roll unit 13 uncludes the smooth surfaced rider roll 14 extending across the width of the machine for surface engagement with the outer wrap of the web 2 on the rewound roll 3. The surface of the roll 14 is preferably a highly finished surface in accordance with conventional practice. The roll 14 functions to smooth out the web 2 and eliminate entrapment of air between the web layers. The rider roll 14 contributes significantly to forming a high quality rewound roll 3. In accordance with the present invention, the rider roll 14 is mounted for movement within the turret 5 as the roll 3 enlarges, as follows. (FIG. 2)

The opposite ends of the roll 14 are rotatably mounted within a generally U-shaped carriage assembly 33. The carriage assembly 33 includes a pair of side plates 22 and 23 mounted for linear movement on similar sliding bearing units 24 including support rods 25 secured to the opposite end frames 10 of the turret 5 by suitable mounting brackets 26. The rods 25 are smooth finished bearing rods, and are formed of a sufficient length to support the rider roll for movement equal to the maximum diameter of the rewound roll 3. A low friction roller bearing unit 27 is slidably mounted on the rod 25 and includes a mounting plate 28 bolted to the carriage side plate 22. The bearing unit 24, for example, may be a pin roller bearing such as manufactured and sold by Thomson Industries Inc. of Manhasset, New York 11030. Any other desired low friction support including various commercially available low friction bearing units can of course be used.

The rider roll 14 is mounted in surface engagement with the rewound roll 3, which moves the roll 14 outwardly essentially against unrestricted movement with change in the diameter of the rewound roll 3.

The weight balance and force control unit 19 is coupled to the rider roll unit 13 to the opposite ends of the machine turret frame 10 and creates a constant load on the roll 14 for the controlled movement of the rider roll 14 into and from engagement with the roll, as more fully described hereinafter.

The rider roll 14 is mounted to a pair of supporting stands 30 and 30' secured to the base of the U-shaped carriage assembly 33. The stands 30 and 30' are similar rigid box-like structures extending from the base 33 in parallel and lateral spaced relation. Rider roll bearings 31 are similarly adjustably secured to the face of the stand 30 and 30'. The roller bearings 31 include mounting flanges 32 slidably mounted to the face of the stand. Locking bolts 34 are threaded through nuts 35 secured to the stand on opposite sides of flange 32. The bolts are adjusted to locate the rider roll 14 on the roll 3.

A roll skew position control shaft 36 is secured to the roll stands 30 and 30' and projects laterally from the stands past the ends of the roll. The outer ends of the shaft 36 are secured to suitable rack and pinion units 37 and 38, with the shaft 36 freely rotatable in suitable bearings 39 on the stands. The sliding motion of the stands 30 and 30' moves the shaft.

The one end of the shaft 36 is coupled to the adjustable rack and pinion unit 37 while the opposite end of the shaft is connected to the relatively fixed rack and pinion unit 38. The adjustable rack and pinion unit 37 permits offsetting of the shaft 36 slightly to establish a slight twisting force on the carriage unit and rider roll 14. This results in a slight offsetting or skewing of the axis of the rider roll 14 relative to the axis of the rewound roll 3. If the web being wound on the wound roll has any form of a wrinkle as a result of some slight minor misalignment within the rewind apparatus, the skewing of the rider roll 14 may be set to completely remove any such defect. Actual tests have indicated that approximate adjusting the skew force on the rider roll creates a force such that a wrinkle along one edge of the web can be moved completely across and ironed out of the wound roll. This of course permits the operator to continuously monitor the roll and maintain maximum quality.

As shown in FIG. 2, in the illustrated embodiment, the rack 40 of unit 38 is secured to a plate 41, which is secured to the bearing support 26. This rigidly fixes the rack 40 to the turret 5 and forms a stationary or fixed support for the shaft 36. The pinion 42 on the end of the shaft 36 is maintained in engagement with the rack teeth. The location of pinion 42 on the rack 40 in relationship to the adjustable rack and pinion unit 37 on the opposite end of the rider roll unit 13 establishes the slight skew or offset relationship and force on the rider roll mechanism.

The rack 43 of the unit 37 is secured to machine frame 10 with a slide unit 44 permitting limited lineal positioning of the rack on the machine frame. With particular reference to FIG. 6, the slide unit 44 is shown including a fixed slide member 45 secured to the machine frame and a support slide 45' moveable therewith. The support slide 45' is fixed to the rack 43. An adjustment control knob 46 is connected to the end of a shaft 47 which is rotatably threaded in a suitable support or block 48 secured to a mounting plate 49. The inner end of the shaft 47 is coupled to the end of the support slide 45'. The coupling includes a low friction bearing 50 on the end of the shaft 47 captured within a bearing portion 48 on the support slide. Rotation of the control knob 46 axially positions the shaft 47 and the interconnected rack 43 to provide slight linear movement of the rack 43 relative to the turret arms 10 and the fixed position of the opposite rack 40 of unit 38.

The rack and pinion unit 38 thus provides a fixed pivot point for the skewing forces applied to the rider roll 14 by adjustment of the adjustable rack and pinion unit 37.

The roll unit 13 thus moves with the enlarging roll 3 with the rotating rider roll 14 in surface engagement with the outer wrap of the web 2 being wound on the roll 3. By establishing and maintaining proper forced engagement of rider roll 14, the web 2 is wound as a smooth and firm roll 3. The counterweight and force unit 19 is coupled to the rider roll unit to establish a constant force on the outer wrap of web 2.

As shown most clearly in FIGS. 3 and 4, the balance and force control unit 19 is generally constructed as a subassembly for securement to the turret support structure for securement to the turret end arms or members 10. The support structure generally includes a mounting plate 52 secured to the turret end frame 10. Spaced support frames 53 are secured to the mounting plate 52 to support the assembly.

As previously described, the weight and force unit 19 includes counterweight unit 20 and force generator unit 21 coupled to each other and to the rider roll unit 13. The unit 20 balances the gravity force of the rider roll unit 13 within the assembly such that its structure creates essentially zero loading on the roll 3. The force unit 21 in turn creates a controlled force on the rider roll 14 and therefore a constant force between the rider roll 14 and the wound roll 3.

The rider roll unit 13 moves in a straight but inclined path which varies with respect to the horizontal as the turret 5 indexes from the winding station 17. The gravity force of the rider roll 14 correspondingly varies. The counterweight unit 20 is oppositely positioned on a parallel path to maintan the zero gravity loading, as the result of a mechanical coupling to the rider roll unit 13.

More particularly, the rider roll 13 is coupled to the force control unit 19 as follows.

As shown most clearly in FIG. 3, a movable bracket 55 is bolted or otherwise secured to the side of the adjacent roll stand 30' immediately beneath the fixed rack and pinion unit 38. The bracket 55 includes an outer plate 56 slidably disposed adjacent a frame plate 57 of the control unit frame structure. A chain drive unit 58 is secured to the bracket plate and is driven thereby. The chain unit 58 includes an open chain 59 having the opposite end 60 and 60' secured to the plate. In the illustrated embodiment of the invention, each end of the chain 59 is similarly connected to the plate. Referring to end 60 of the chain, an adjustable threaded rod 66 is secured to the end of the chain and threaded into a rotating nut 61 secured to the plate. Rotation of the nut 61 draws the rod inwardly to the nut and tightens the chain onto a plurality of spaced sprockets 62.

The chain 59 loops about the plurality of sprockets 62 which are driven by the movement of the chain. In the illustrated embodiment of the invention, four sprockets are illustrated including 3 idler sprockets 62 and a roll position sprocket 63. The sprockets are paired and mounted to opposite ends of frame plate of the control unit 19 such that the chain moves in a rectangular path. The sprockets are appropriately secured on rotating shafts to the frame plate of the control unit frame structure. The position sprocket 63 is fixed to the mounting shaft 64 which rotates with the sprocket and chain, and provides a rotating output precisely related to the position of the rider roll 14. The position information is coupled to and transmitted through a coupling unit 65, shown as chain and sprocket unit, to the counter-balance weight 20 and continuously balances the changing gravity force of the rider roll 14 as the roll moves 14 outwardly with the enlarging rewound roll 3.

The counterweight and force unit 19 generally includes a cylindrical weight 20 slidably mounted on a support shaft or rod 68. A low friction bearing, not shown, is interposed between the weight and the rod to create a low friction support of the weight. The weight 20 is positively positioned through a chain unit 69 coupled to the rider roll unit 13 and is located for opposite movement in a common plane with the plane of movement of the rider roll 14 through the coupling chain unit 65 and the position chain unit 58. In the illustrated embodiment, chain unit 69 includes an open chain 70 having its ends connected to lugs on the opposite ends of the weight 20 as shown at 71 and 72 in FIGS. 3 and 4. The chain as shown, is a conventional link chain with the end releasably secured to lugs 71 and 72 on the weight. The chain 70 extends about paired sprockets 73 and 74 secured to the opposite ends of the support structure for the counterweight unit 19. The paired sprockets are mounted to the frame plate to the opposite ends of the weight unit and establish a rectangular chain path. The plane of the chain generally is parallel to the position chain 59 of the rider roll unit 13. The one sprocket 73 is coupled to the roll driven position chain 59 via the coupling chain unit 65 and is correspondingly positioned. Unit 65 is a variable coupling chain drive and includes a large reduction sprocket 75 secured to a common shaft 76 with the sprocket 73. The opposite end of the coupling chain unit 65 is secured about a sprocket 77 secured to the shaft 64 of the roll driven chain sprocket 63. The sprockets coupled to the respective chains are selected to provide a proportionate movement of the weight 20 with the roll 14 to maintain an essentially zero force as a result of gravity forces of the rider roll unit 13.

The total force created by the weight balance and pressure control unit 13 therefore results from the force unit 21.

The constant force unit 21 is shown as a pistonless cylinder unit which includes a sliding output member, not shown, coupled to the counterweight 20 and establishing a predetermined constant load on the weight for all positions of the weight and rider roll unit 13. The force is transmitted to the rider roll unit 13 through the previously described chain coupling and establishes a predetermined constant force engagement between the rider roll 14 and the enlarging wound roll 3. This force is independent of the position of the rider roll 14 as a result of the counter balancing of the weight of the rider roll. Constant pressure pistonless cylinder units are commercially available. A satisfactory unit is a model 1030-00105-15-1/2 manufactured and sold by Tol-O-Matic Inc. of 1028 South 3rd. Street, Minneapolis, MN 55415.

The interior rider roll 14 thereby establishes and maintains an accurate pressure loading on the rewound roll during the forming of the enlarging roll including the period of transfer from the rewind station to the unloading station.

In summary, the rider roll unit 13 with the control units 19 is mounted to the turret 5 in accordance with the directional rotation of the turret between the winding station and load/unload stations. In addition, the rider roll unit and the interconnected control units 19 and 19' are mounted for engaging the core unit and roll at the time of web transfer at the winding station, or for engaging the roll at the time of indexing from the winding station and just prior to the cutoff and transfer of the web.

In all mountings and roll engagement, the rider roll unit 13 is mounted with the rider roll 14 engaging the roll 3 and rotating with the indexing wound roll. As the roll indexes, the position is transmitted through the chain units, and to the weight to position the weight to counterbalance the gravity force of the rider roll 14. The engagement force of the cyliner unit is transmitted through the chain units to maintain the desired force on the outer web layer being wound onto the wound roll.

In addition, if the operator detects a wrinkle in the web being wound on the roll, the skew adjustment mechanism or unit is adjusted to skew the axis the rider roll in its plane of movement and thereby wipes the wrinkle or fold from the web.

The illustrated and described embodiment of the present invention discloses a commercial machine.

Figure 7:
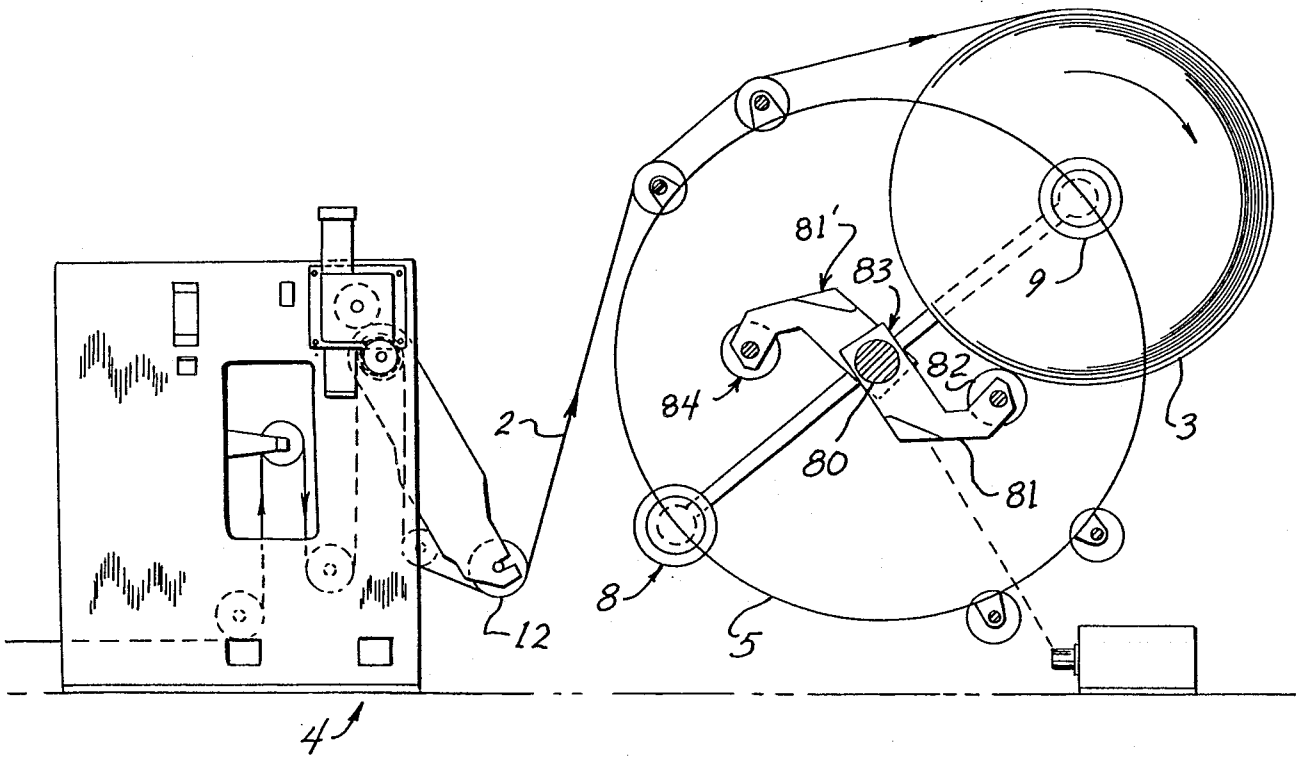
FIG. 7 is a view of an alternate embodiment of the invention.

In another embodiment of the invention shown in FIG. 7, the turret unit 5 is formed of a generally known construction with core units 8 and 9 mounted to the opposite ends of a relatively rigid support arm and rotatably mounted to the rotating turret shaft 80. An interior or inside rider roll unit 81 is shown including a rider roll 82 for engaging the finished or completed roll 3 at least during the indexing and final winding of the web 2, including the tail portion. In the illustrated embodiment, the rider roll 82 is pivoted to the shaft 80 as at 83 and thus moves outwardly with the enlarging roll 3. A separate rider roll 84 of unit 81 is provided for the opposite core unit 8 and similarly functions during the forming of a roll thereon. The interior rider rolls 82 and 84 also serves to iron out air which might be trapped between the web layers and also maintains control of the web during the indexing.

Other embodiments of interior rider rolls will be readily provided based on the teaching herein, including the special balanced rider roll unit mounted as an integral part of the roll supporting and indexing support structure for position of the roll between a winding station and an unload station. Generally, the balanced rider roll embodiment includes a suitable unit or construction to establish and maintain a constant surface engaging force on the rider roll unit for optimum forming of the wound roll. Although not essential within the broadest respect of the invention, a suitable counterweight and force unit is of course preferably provided to provide unique wrapping control which is desirable and may be required to meet certain web specifications and the acceptable commercialization of the winding apparatus.

The present invention thus provides a versatile interior rider roll unit for improved winding of a roll from an incoming web.

Various modes of carrying out the invention are contemplated as being within the scope of the following claims particularly pointing out and distinctly claiming the subject matter which is regarded as the invention.

I claim:

1. A winding apparatus, comprising a rotating support unit for supporting a core unit and for including a core support unit moving said core unit into and from a winding station during the winding of a web on the core unit to form a wound roll, an interior rider roll unit including a mounting frame structure secured to said rotating support unit, said interior rider roll unit including a carriage structure movably secured to said frame structure, a rider roll rotatably secured to said carriage structure and located to engage said wound roll on said core unit and moving outwardly by the enlargement of the wound roll, a force control unit secured to said rider frame structure and including a position member coupled to said carriage and moving with said carriage, said control unit including a counter-balance weight unit coupled to said position member and located and moved therewith on said frame structure to continuously counterbalance the weight of the rider roll unit and thereby establish an esentially zero gravity weight force on said rider roll.

2. The winding apparatus of claim 1 including a constant force unit coupled to said rider roll and establishing a constant forced engagement of said rider roll with said engaged wound roll.

3. The apparatus of claim 2 wherein said carriage structure includes a supporting straight track secured to said frame structure and said rider roll unit moves on said track, said track being oriented on a chordal line of the rotating path of said core unit.

4. The apparatus of claim 3 including a roll positioning means to control the alignment of said rider roll relative to the rewind axis of said core unit and including adjustable means for establishing a controlled skewing force on said rider roll, said skewing force serving to remove any offset in the outermost web layer being wound on said enlarging wound roll.

5. The apparatus of claim 1 including a roll positioning means to control the alignment of said rider roll relative to the rewind axis of said core unit and including adjustable means for establishing a controlled skewing force on said rider roll, said skewing force serving to remove any offset in the outermost web layer being wound on said enlarging wound roll.

6. The apparatus of claim 5 wherein said roll positioning means includes a first means secured to one end of the rider roll establishing a fixed rolling support and a second means secured to the opposite end of the rider roll and establishing an adjustable rolling support to move the roll axis.

7. The winding apparatus of claim 2 wherein said weight unit includes a track and a weight slidably mounted on said track, said constant force unit includes a cylinder unit having a force member connected to and moving with said weight, and a position coupling unit including a member secured to said rider roll unit and a member secured to said weight and positively positioning said weight to counterbalance the gravity force of the rider roll unit with said rider roll engaging said wound roll.

8. The interior rider roll apparatus of claim 1 including skewing means coupled to said carriage structure and to said frame structure and operable to adjust the rider roll axis in the plane of the linear, movement of the rider roll.

9. An interior rider roll apparatus adopted to be mounted to a rotating support having at least one driven core unit for winding a web on the core unit to form an enlarging roll, said interior rider roll apparatus comprising a supporting frame structure adapted to be fixed to said rotating support for simultaneous rotation therewith, a rider roll unit, a carriage unit slidably mounted on said frame structure for linear movement forward and away from said core unit, roller bearing units secured to said carriage and rotatably supporting said rider roll unit for low friction movement, a position sensing plate member secured to said rider roll unit, a chain secured to said plate member, a plurality of distributed sprockets secured to said frame structure and having said chain mounted thereon, at least one of said sprockets having a transfer sprocket secured thereto and driven by said chain, a counterweight unit having a supporting shaft fixed to said frame structure and slidably supporting a counterweight for linear movement in a plane parallel to the plane of said rider roll, a chain drive secured to said weight unit and wound about a plurality of sprockets including a transfer sprocket, a transfer chain coupling said transfer sprockets and establishing a corresponding positioning of the counterweight unit with said rider roll unit as said wound roll enlarges, and a constant force pneumatic cylinder unit mounted in spaced parallel relation to said counterweight and connected to said counterweight for corresponding positioning, said cylinder unit establishing a constant force on said counterweight, said force being transmitted through said drive system to said rider roll unit to establish and maintain a predetermined constant force between said rider roll and said enlarging roll.

10. The interior rider roll apparatus of claim 9 including skewing means coupled to said carriage structure and to said frame structure and operable to adjust the rider roll axis in the plane of the linear movement of the rider roll.

11. The interior rider roll apparatus of claim 9 wherein said carriage unit includes a pair of side plates interconnected by a base plate, laterally extending bearing brackets secured to said side plates and projecting outwardly therefrom, bearing shafts fixed to said frame structure, roller bearing members mounted on said bearing shafts and secured to said laterally extending bearing brackets and supporting said carriage unit for linear movement on said bearing shafts, first and second bearing stands fixed to said base and extending in spaced parallel relation between said carriage side plates, rider roll bearing secured to the outer end faces of said stands, said rider roll having end shafts journaled in said bearings on said stands.

12. The interior rider roll apparatus of claim 11 including a shaft member rotatably mounted to said bearing stands of said carriage unit, said shaft member projecting laterally outwardly of said rider roll, first and second pinion gears rotatably mounted on of the ends of said shaft, a first rack secured to said frame structure and located in meshing engagement with said first pinion gear, a second rack secured to said frame structure and in meshing engagement with said second pinion gear, a slide support connected to said frame structure and to said second rack and supporting of said rack for longitudinal movement of said rack, an adjustable locking unit secured to said rack and to said frame structure including means for adjusting the position of said rack and thereby adjusting the angular orientation of said shaft in preset angular orientation to the axis of the wound roll, said angular orientation being transmitted through the connection of the bearing stands to said rider roll bearings and to said rider roll to provide corresponding skewed mounting of the rider roll on the enlarging wound roll.

13. The apparatus of claim 9 wherein said frame structure includes a flat mounting plate adapted to be rigidly affixed to said rotating support in outwardly spaced relation to said rider roll, a pair of spaced parallel support brackets secured to said mounting plate and projecting outwardly therefrom, said weight unit including a weight support shaft secured between said brackets, a cylindrical weight member slidably mounted on said shaft and movable on said shaft, roller bearing means between said weight and said weight shaft to establish an essentially low friction movement of said weight on said shaft.

14. The apparatus of claim 13 wherein said force unit includes a cylinder unit secured between said mounting brackets in outwardly spaced parallel relation to said support plates, said cylinder having a sliding output member mounted to the side of the cylinder and movable along the cylinder, means connecting said sliding member to said weight for correspondingly positioning with the movement of said weight and establishing a force tending to move said weight to one end of said weight shaft.

15. A web winding apparatus for winding of a roll from a continously moving web of indefinite length, comprising a turret having a rotating support for rotation about a horizontal axis, said turret having laterally spaced first and second support arms with a plurality of circumferentially spaced core support members having a rotational axis parallel to the turret axis for supporting a core unit, power means for indexing of said turret to sequentially align said core support members with the winding station for receiving the web and winding the web on the core unit, an interior rider roll unit secured to said support arms for each of said core support members, each of said interior rider roll units including a carriage unit secured to said support arms for movement relative to said core support members and a rider roll mounted to said carriage unit with a rider roll axis generally parallel to the axis of core support members, each rider roll unit including a first and a second control unit connected respectively to the first and second support arms, each of said control units being identically formed and including a roll position related mechanism connected to the carriage unit and having an output member positioned in accordance with the rider roll, said control units including a counterbalance weight unit movably mounted and a weight positioning mechanism having an output connected to the weight unit, a coupling mechanism connecting said positioning mechanism and said weight mechanism to position said weight to counterbalance the weight of the rider roll, said coupling mechanism having a fixed reduction in the movement of the weight with respect to the movement of the rider roll.

16. The apparatus of claim 15 wherein said weight positioning mechanism includes a weight chain unit mounted to a two set support plate and including a chain member fixed to said weight and wrapped about said weight, a plurality of spaced sprockets rotatably mounted to a mounting plate and supporting said chain for moving of said weight on said shaft, said roll positioning mechanism includes a roll position chain unit mounted on said plate in laterally spaced relation to said weight chain unit, said weight chain unit including a plurality of spaced sprockets mounted to said plate and supporting said roll position chain for movement in a plane parallel to the plane of said weight chain unit, said coupling mechanism includes a transfer chain unit having sprocket members secured to a sprocket of said weight chain unit and to a sprocket of said transfer chain unit and establishing a reduction in movement of the weight chain unit with the position chain unit, said roll position chain unit having a coupling plate adapted to be affixed to a rider roll for simultaneous positioning with the position of the linear moving rider roll, said coupling plate being connected to said rider roll to position said weight unit to counter-balance the weight of said rider roll unit and thereby establish an essentially weight-free force at said rider roll, said cylinder unit serving to establish a constant holding force on said rider roll unit for engagement with the wound roll.

17. A winding apparatus, comprising a rotating turret including spaced core support units for supporting a core unit and for moving said core units into and from a winding station during the winding of a web on the core unit to form a wound roll, an interior rider roll unit including a mounting frame structure movably secured to said turret and a rider roll mounted to said frame structure, said rider roll located to engage said wound roll on said core unit and moving outwardly by the enlargement of the wound roll to hold the outer wrap of the roll in close engagement with the roll, a force control unit secured to said frame structure and including a position member coupled to said rider roll and moving therewith, said control unit including a counter-balance weight unit coupled to said position member and located and moved therewith on said frame structure to continuously counter-balance the weight of the rider roll and thereby establish an essentially zero gravity weight force on said rider roll, and a constant force unit coupled to said rider roll and establishing a constant force engagement of said rider roll with said engaged wound roll.

18. A winding apparatus for winding a film-like web into a roll, comprising a rotating support unit including a core support unit for moving a core unit into and from a winding station during the winding of a web on the core unit to form a wound roll, an interior rider roll unit, a movable mount structure connected to said roll unit and to said rotating core support unit and movable by said rider roll unit, said interior rider roll unit engaging said wound roll on said core unit and moving outwardly by the enlargement of the wound roll, said rider roll unit and wound roll having parallel axii establishing engagement of the rider roll unit with the wound roll over the width of the web, a force control unit secured to said mount structure and including a counter-balance weight unit located and moved on said mount structure to continuously counterbalance the weight of the rider roll unit and thereby establish an essentially zero gravity weight force on said rider roll unit.

19. The winding apparatus of claim 18 said force control unit includes a constant force element coupled to said rider roll and establishing a constant force engagement of said rider roll with said engaged wound roll.

20. A web winding apparatus for winding of a roll from a continuous moving web of indefinite length, comprising a turret having rotating support for rotation about a horizontal axis, said turret having laterally spaced first and second support arms with a plurality of circumferentially spaced core support members having a rotation axis parallel to the turret axis for supporting a core unit, power means for indexing of said turret to sequentially align said core support members with the winding station for receiving the web and winding the web on the core unit, an interior rider roll unit secured to said support arms for each of said core support members, each of said interior rider roll units including a movable support for movement relative to said core support members and a rider roll mounted to said movable support with a rider roll axis generally parallel to the axis of core support members, a control unit coupled to said movable support and including a counterbalance weight unit movably mounted and a weight position mechanism having an output connected to the weight unit, and a coupling mechanism connecting said position mechanism and said weight mechanism to position said weight to counterbalance the weight of the rider roll.

* * * * *

UNITED STATES PATENT AND TRADEMARK OFFICE

CERTIFICATE OF CORRECTION

PATENT NO. : 4,971,263

DATED : November 20, 1990

INVENTOR(S) : LARRY P. BELONGIA

It is certified that error appears in the above-identified patent and that said Letters Patent is hereby corrected as shown below:

Claim 8, column 10, line 45, after "linear" delete "," (comma); Claim 9, column 10, line 47, delete "adopted" and substitute therefor ---adapted---; Claim 12, column 11, line 35, after "on" insert ---each---; Claim 17, column 13, line 17, delete "force" and substitute therfor ---forced---

Signed and Sealed this

Ninth Day of June, 1992

*Attest:*

DOUGLAS B. COMER

*Attesting Officer*

*Acting Commissioner of Patents and Trademarks*